US006837449B2

(12) United States Patent
Dantes et al.

(10) Patent No.: US 6,837,449 B2
(45) Date of Patent: Jan. 4, 2005

(54) FUEL INJECTION VALVE

(75) Inventors: Günter Dantes, Eberdingen (DE); Detlef Nowak, Untergruppenbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/363,446

(22) PCT Filed: Jun. 18, 2002

(86) PCT No.: PCT/DE02/02208

§ 371 (c)(1),
(2), (4) Date: Jul. 29, 2003

(87) PCT Pub. No.: WO03/002869

PCT Pub. Date: Jan. 9, 2003

(65) Prior Publication Data

US 2004/0099754 A1 May 27, 2004

(30) Foreign Application Priority Data

Jun. 26, 2001 (DE) ..... 101 30 685

(51) Int. Cl.[7] ..... F02M 61/00

(52) U.S. Cl. ..... 239/533.12; 239/533.2; 239/533.9; 239/288; 239/590.3; 239/585.1; 239/585.5; 239/DIG. 23

(58) Field of Search ..... 239/533.2, 533.9, 239/533.12, 288, 288.3, 288.5, 575, 590.3, 585.1, 585.2, 585.3, 585.4, 585.5, DIG. 23

(56) References Cited

U.S. PATENT DOCUMENTS 4,925,110 A * 5/1990 Takeda et al. ..... 239/533.12
5,400,969 A * 3/1995 Keene ..... 239/136
5,707,012 A * 1/1998 Maier et al. ..... 239/575
5,915,352 A * 6/1999 Okamoto et al. ..... 239/463
6,145,762 A * 11/2000 Orloff et al. ..... 239/533.9

FOREIGN PATENT DOCUMENTS

| | | | |
|---|---|---|---|
| DE | 36 23 223 | 2/1988 | |
| DE | 39 27 390 | 2/1991 | |
| DE | 40 19 752 | 1/1992 | |
| DE | 198 04 463 | 8/1999 | |
| JP | 58 90365 | 5/1983 | |
| JP | 63215869 A * | 9/1988 | ..... F02M/51/06 |
| JP | 04 298 627 | 10/1992 | |
| JP | 04 325 712 | 11/1992 | |
| JP | 08 144 893 | 6/1996 | |

* cited by examiner

*Primary Examiner*—Robin O. Evans
(74) *Attorney, Agent, or Firm*—Kenyon & Kenyon

(57) ABSTRACT

A fuel injector for fuel-injection systems of internal combustion engines includes an actuator, a valve needle, which is able to be activated by the actuator to actuate a valve-closure member, which, together with a valve-seat surface formed at a valve-seat member, forms a sealing seat; and a plurality of spray-discharge orifices which is formed in the valve-seat member. At a discharge-side end of the fuel injector, a nozzle-orifice cover is positioned, which shields the spray-discharge orifices from the combustion chamber of the internal combustion engine.

12 Claims, 2 Drawing Sheets

FUEL INJECTION VALVE

FIELD OF THE INVENTION

The present invention relates to a fuel injector.

BACKGROUND INFORMATION

German Published Patent Application No. 198 04 463 describes a fuel-injection system for a mixture-compressing internal combustion engine having external ignition is known, which includes a fuel injector injecting fuel into a combustion chamber having a piston/cylinder design and which has a spark plug projecting into the combustion chamber. The fuel injector is provided with at least one row of injection orifices distributed across the circumference of the fuel injector. By selectively injecting fuel via the injection orifices, a jet-directed combustion method is realized by a mixture cloud being formed using at least one jet.

Disadvantageous in the fuel injector known from the aforementioned printed publication, in particular, is the deposit formation in the spray-discharge orifices, these deposits clogging the orifices and causing an unacceptable reduction in the flow rate through the injector. This leads to malfunctions of the internal combustion engine.

SUMMARY OF THE INVENTION

In contrast, the fuel injector according to the present invention has the advantage over the related art that a nozzle-orifice cover located downstream from the spray-discharge orifices lowers the temperature of the flame front of the mixture cloud burning through in the area of the spray-discharge orifices to such a degree that no fuel is able to deposit at the valve-seat member, thereby avoiding a clogging of the spray-discharge orifices with coke residue.

The nozzle-orifice cover advantageously includes a protective cap and a plurality of spacers which are used to fixate the nozzle-orifice cover on the discharge-side end of the fuel injector.

In addition, it is advantageous that the number of spacers corresponds to the number of spray-discharge orifices. This makes it possible to position the spacers in such a way that the injection process is not influenced.

Moreover, it is advantageous that the nozzle-orifice cover may be produced in a simple manner in one piece from sheet metal by stamping and bending.

By the preferred form of the protective cap of the nozzle-orifice cover, which has a conical design, a maximum coking protection may be achieved while keeping the interruption of the injection process to a minimum.

DETAILED DESCRIPTION

Figure 1:
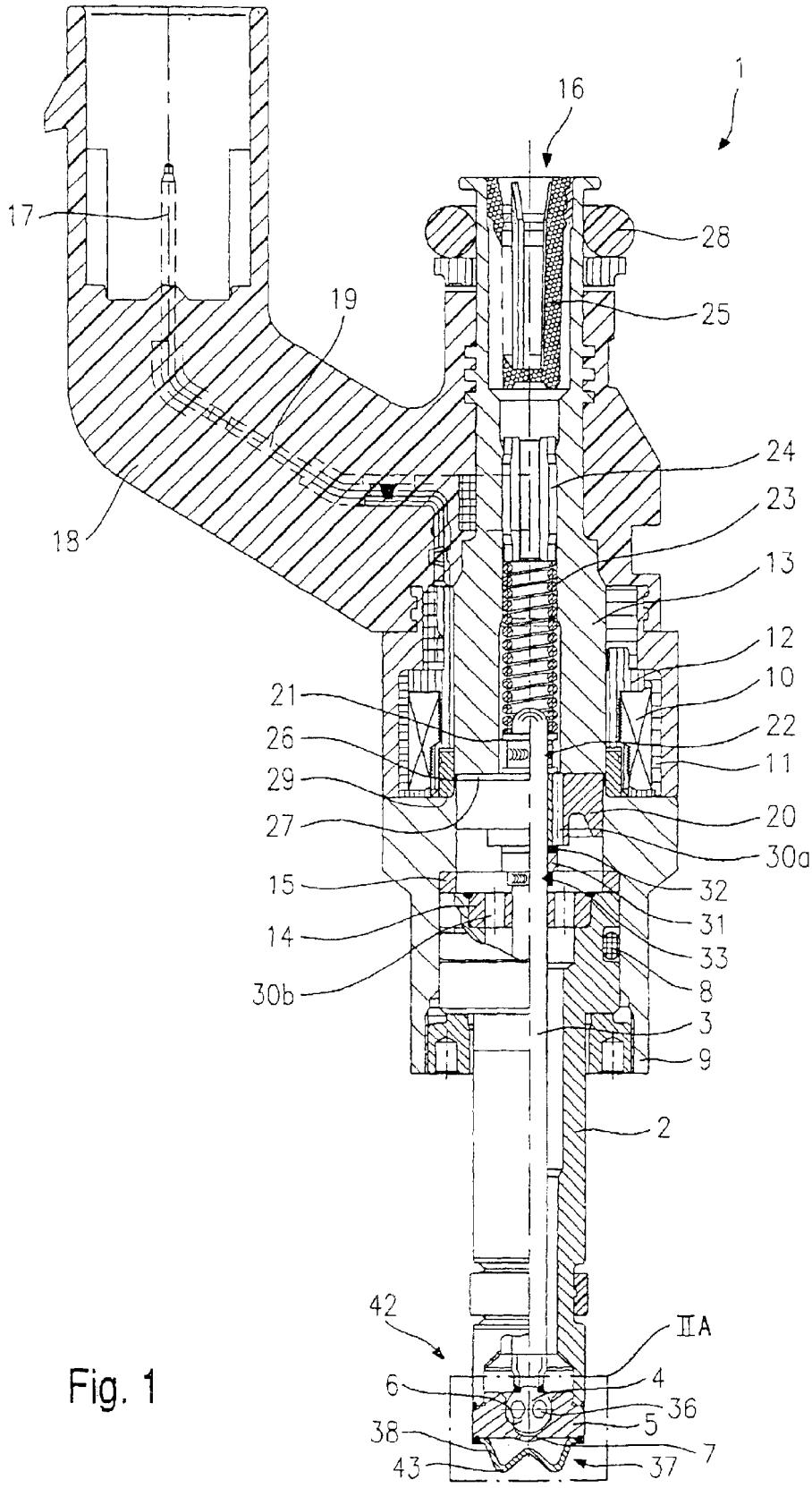
FIG. 1 shows a schematic section through an exemplary embodiment of a fuel injector configured according to the present invention, in an overall view.

In a part-sectional representation, FIG. 1 shows an exemplary embodiment of a fuel injector 1 designed according to the present invention. It is in the form of a fuel injector 1 for fuel-injection systems of mixture-compressing internal combustion engines having external ignition. Fuel injector 1 is suited for the direct injection of fuel into a combustion chamber (not shown) of an internal combustion engine.

Fuel injector 1 is made up of a nozzle body 2 in which a valve needle 3 is positioned. Valve needle 3 is in operative connection with a valve-closure member 4, for instance, via a welding seam 41, the valve-closure member 4 cooperating with a valve-seat surface 6, located on a valve-seat member 5, to form a sealing seat. In the exemplary embodiment, fuel injector 1 is an inwardly opening fuel injector which has two spray-discharge orifices 7, for example.

Valve-closure member 4 of fuel injector 1 configured according to the present invention has a nearly spherical form, thereby achieving an offset-free, cardanic valve-needle guidance, which provides for a precise functioning of fuel injector 1.

Valve-seat member 5 of fuel injector 1 has a cup-shaped design, for example, and, by its form, contributes to the valve-needle guidance. Valve-seat member 5 is inserted into a discharge-side recess 34 of nozzle body 2 and joined to nozzle body 2 by a welding seam 35.

Seal 8 seals nozzle body 2 from an outer pole 9 of a magnetic coil 10 which functions as an actuator for valve needle 3. Magnetic coil 10 is encapsulated in a coil housing 11 and wound on a coil brace 12, which rests against an inner pole 13 of magnetic coil 10. Inner pole 13 and outer pole 9 are separated from one another by a gap 26 and are braced against a connecting member 29. Magnetic coil 10 is energized via a line 19 by an electric current, which may be supplied via an electrical plug contact 17. A plastic coating 18, which may be extruded onto inner pole 13, encloses plug contact 17.

Valve needle 3 is guided in a valve-needle guide 14, which is disk-shaped. A paired adjustment disk 15 is used to adjust the (valve) lift. On the other side of adjustment disk 15 is an armature 20 which, via a first flange 21, is connected by force-locking to valve needle 3, which is connected to first flange 21 by a welding seam 22. Braced against first flange 21 is a restoring spring 23 which, in the present design of fuel injector 1, is provided with an initial stress by a sleeve 24.

On the discharge-side of armature 20 is a second flange 31 which is used as lower armature stop. It is connected via a welding seem 33 to valve needle 3 in force-locking manner. An elastic intermediate ring 32 is positioned between armature 20 and second flange 31 to damp armature bounce during closing of fuel injector 1.

Fuel channels 30*a* and 30*b* run in valve-needle guide 14 and in armature 20. The fuel is supplied via a central fuel feed 16 and filtered by a filter element 25. Beveled sections 36 at valve-closure member 4 assume the fuel supply to the sealing seat in the area of valve-seat member 5. A seal 28 seals fuel injector 1 from a distributor line (not shown further).

According to the present invention, fuel injector 1 is provided with a nozzle-orifice cover 37 at valve-seat member 5, which is positioned in a recess 34 of nozzle body 2 and connected thereto by a welding seam 35, for example. Nozzle-orifice cover 37 is mounted downstream from spray-discharge orifices 7. By its placement on the discharge side of spray-discharge orifices 7, nozzle-orifice cover 37 reduces the coking tendency, thereby preventing malfunctions of fuel injector 1 due to clogging of spray-discharge orifices 7, as well as an unacceptable reduction in the fuel flow. The discharge-side end 42 of fuel injector 1 with the measures according to the present invention is shown in greater detail in FIGS. 2A and 2B.

In the rest state of fuel injector 1, restoring spring 23 acts upon first flange 21 at valve needle 3, contrary to a lift direction, in such a way that valve-closure member 4 is sealingly retained against valve seat 6. Armature 20 rests on intermediate ring 32, which is supported on second flange 31. In response to excitation of magnetic coil 10, it builds up a magnetic field which moves armature 20 in the lift direction, against the spring force of restoring spring 23. Armature 20 carries along first flange 21, which is welded to valve needle 3, and thus valve needle 3, in the lift direction as well. Valve-closure member 4, being in operative connection with valve needle 3, lifts off from valve seat surface 6, thereby discharging fuel at spray-discharge orifices 7.

When the coil current is turned off, once the magnetic field has sufficiently decayed, armature 20 falls away from inner pole 13, due to the pressure of restoring spring 23 on first flange 21, whereupon valve needle 3 moves in a direction counter to the lift. As a result, valve closure member 4 comes to rest on valve-seat surface 6, and fuel injector 1 is closed. Armature 20 comes to rest against the armature stop formed by second flange 31.

Figure 2A:
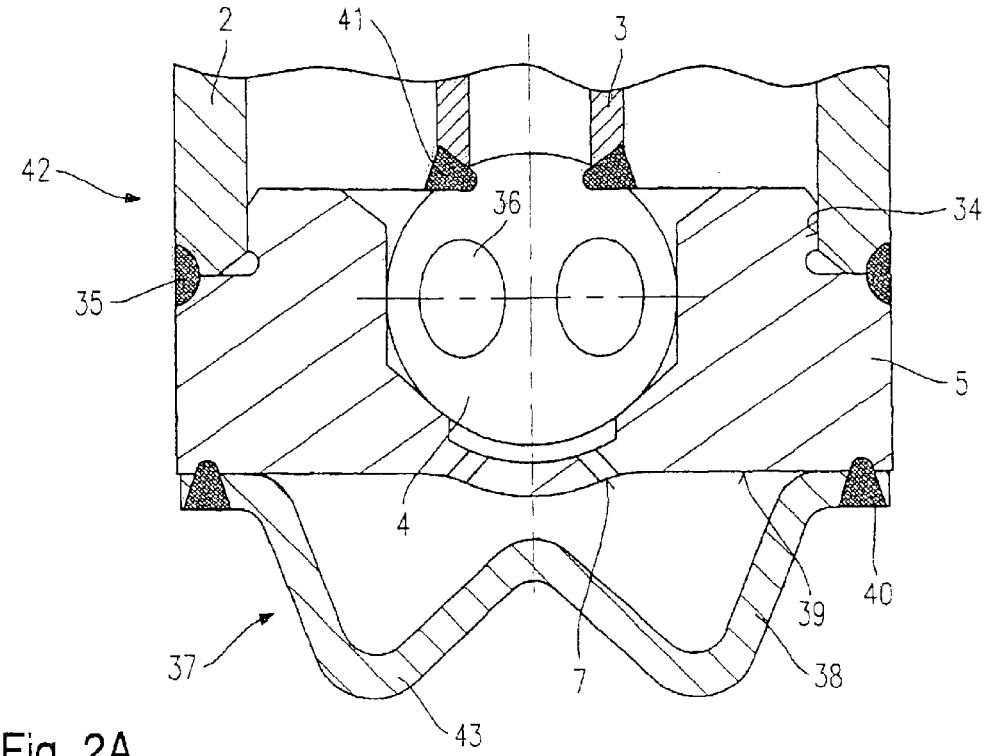
FIG. 2A shows a schematic section through the discharge-side section of the exemplary embodiment of the fuel injector according to the present invention represented in FIG. 1, in region IIA in FIG. 1.

In a part-sectional view, FIG. 2A shows the cut-away portion, designated IIA in FIG. 1, from the exemplary embodiment of a fuel injector 1 designed according to the present invention, as represented in FIG. 1.

As already sketched in FIG. 1, valve-seat member 5 in the exemplary embodiment has a nozzle-orifice cover 37 at an outer end face 39 facing the combustion chamber (not shown further). Nozzle-orifice cover 37 has an inner protective cap 43 and a plurality of external spacers 38, which are affixed on valve-seat member 5, for instance, by spot-welded seams 40. Protective cap 43 and spacers 38 are preferably designed in one piece and able to be produced from sheet metal, for instance, by stamping and bending.

By placing nozzle-orifice cover 37 downstream from spray-discharge orifices 7, coke deposits on spray-discharge orifices 7 may be reduced. Since the diameter of spray-discharge orifices 7, typically, is approximately 100 $\mu$m, the danger of spray-discharge orifices 7 getting clogged over time by the forming of deposits, and the flow rate being unacceptably restricted as a result, is usually relatively high. This is the result, in particular, of the high temperatures during the through-ignition of the mixture cloud injected into the combustion chamber, since this causes fuel components to deposit on the tip of fuel injector 1. By the mounting of nozzle-orifice cover 37, the surface temperature in the discharge region of spray-discharge orifices 7 may be reduced to such a degree that spray-discharge orifices 7 are unable to become clogged by coking residue. In this manner, nozzle-orifice cover 37, which, thus, has a flameproofing function, prevents the spreading of the flame front in the area between nozzle-orifice cover 37 and valve-seat member 5.

The afore-discussed flame-proofing function of nozzle-orifice cover 37 may be enhanced by an appropriate form design of protective cap 43. It is preferably designed in the form of a cone, the tip of the cone pointing counter to the spray-off direction of the fuel.

Figure 2B:
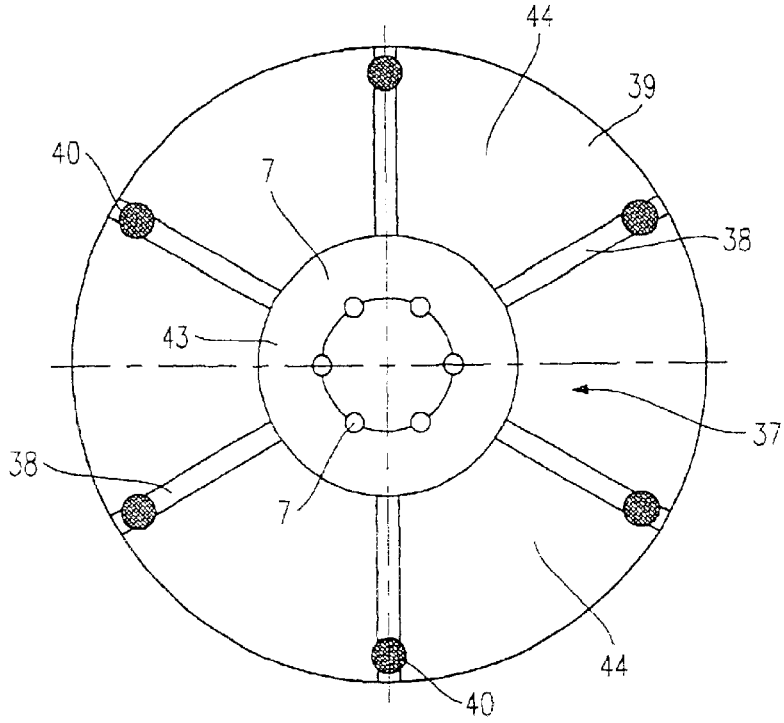
FIG. 2B shows a bottom view of the nozzle-orifice cover configured according to the present invention, counter to the flow direction in FIG. 2A.

FIG. 2B, in a bottom view, counter to the flow direction of the fuel, shows valve-seat member 5 of fuel injector 1 configured according to the present invention, with nozzle-orifice cover 37 affixed thereto, into which spray-discharge orifices 7 have been projected.

In the preferred exemplary embodiment, nozzle-orifice cover 37 has six spacers 38 which are arrayed with even angular spacings at interspaces 44 relative to each other. In order for spacers 38 not to obstruct the injection process from spray-discharge orifices 7, spray-discharge orifices 7 are in each case located on a bisectrix of the angles enclosed by two spacers 38. This makes it possible to prevent a wetting of nozzle-orifice cap 37. The conical shape of protective cover 43, which has already been described earlier, also contributes to an injection that is free of wetting, since the fuel jets leaving spray-discharge orifices 7 are guided tangentially along the flanks of protective cap 43.

Due to its simple manufacturing process, nozzle-orifice cover 37 is able to be adapted without much effort to configurations of spray-discharge orifices 7 which, for instance, are provided with more or fewer, or irregularly arrayed spray-discharge orifices 7. In this case, the number of spacers 38 and their position relative to one another must merely be adapted to the requirements. However, in all instances inner protective cap 43 should always cover all spray-discharge orifices 7 in a projection into a plane, as this is illustrated in FIG. 2B.

The present invention is not limited to the exemplary embodiments shown and may be applied to various configurations of fuel injectors 1.

What is claimed is:

1. A fuel injector for a fuel-injection system of an internal combustion engine, comprising:

a valve needle;

a valve-closure member;

a valve-seat surface formed at a valve-seat member;

an actuator, the valve needle being activatable by the actuator to actuate the valve-closure member, the valve-closure member forming a sealing seat together with the valve-seat surface;

a structure including at least one spray-discharge orifice formed downstream from the valve-seat surface; and a nozzle-orifice cover positioned at a discharge-side end of the fuel injector and for shielding the at least one spray-discharge orifice from a combustion chamber of the internal combustion engine;

wherein:

the nozzle-orifice cover includes a plurality of outer spacers and an inner protective cap; and a number of the outer spacers is equal to a number of the at least one spray-discharge orifice.

2. The fuel injector as recited in claim 1, wherein:

the inner protective cap is produced in one piece with the outer spacers.

3. The fuel injector as recited in claim 1, wherein:

the nozzle-orifice cover is produced by stamping and bending.

4. The fuel injector as recited in claim 1, wherein:

the number of the outer spacers is six.

5. The fuel injector as recited in claim 1, wherein:

the outer spacers are positioned such that the at least one spray-discharge orifice is in each case located in a clearance space between the outer spacers.

6. The fuel injector as recited in claim 1, wherein:

the inner protective cap has a conical shape and includes a conical protective cap.

7. A fuel injector for a fuel-injection system of an internal combustion engine, comprising:

a valve needle;

a valve-closure member;

a valve-seat surface formed at a valve-seat member;

an actuator, the valve needle being activatable by the actuator to actuate the valve-closure member, the valve-closure member forming a sealing seat together with the valve-seat surface;

a structure including at least one spray-discharge orifice formed downstream from the valve-seat surface; and a nozzle-orifice cover positioned at a discharge-side end of the fuel injector and for shielding the at least one spray-discharge orifice from a combustion chamber of the internal combustion engine;

wherein:

the nozzle-orifice cover includes a plurality of outer spacers and an inner protective cap;

the inner protective cap has a conical shape and includes a conical protective cap; and the conical protective cap extends in a widening manner in a discharge direction of a fuel.

8. The fuel injector as recited in claim 1, wherein:

the nozzle-orifice cover is joined to the valve-seat member by spot-welded seams.

9. The fuel injector as recited in claim 7, wherein:

the inner protective cap is produced in one piece with the outer spacers.

10. The fuel injector as recited in claim 7, wherein:

the nozzle-orifice cover is produced by stamping and bending.

11. The fuel injector as recited in claim 7, wherein:

the outer spacers are positioned such that the at least one spray-discharge orifice is in each case located in a clearance space between the outer spacers.

12. The fuel injector as recited in claim 7, wherein:

the nozzle-orifice cover is joined to the valve-seat member by spot-welded seams.

* * * * *